United States Patent [19]

Imperi

[11] 4,410,144

[45] Oct. 18, 1983

[54] SYNCHRONOUSLY COORDINATED COUNTERROTATED CRUSHER ROLL TEETH SYSTEM

[75] Inventor: Aldo P. Imperi, Grand Blanc, Mich.

[73] Assignee: General Steel Industries, Inc., St. Louis, Mo.

[21] Appl. No.: 238,363

[22] Filed: Feb. 26, 1981

[51] Int. Cl.[3] ..... B02C 18/18

[52] U.S. Cl. ..... 241/236

[58] Field of Search ..... 241/236

[56] References Cited

U.S. PATENT DOCUMENTS

| | | | |
|---|---|---|---|
| 203,364 | 5/1878 | Newell | 241/236 |
| 1,671,868 | 5/1928 | McGougan et al. | 241/236X |
| 2,150,278 | 3/1939 | Hegenbarth | 241/236 X |
| 2,219,077 | 10/1940 | Pharo | 241/236 X |
| 3,240,436 | 3/1966 | Mylting | 241/236 X |
| 3,664,592 | 5/1972 | Schweigert et al. | 241/236 UX |
| 4,260,115 | 4/1981 | Hatanaka | 241/236 |

FOREIGN PATENT DOCUMENTS

| | | | |
|---|---|---|---|
| 2831953 | 12/1979 | Fed. Rep. of Germany | 241/236 |
| 552881 | 12/1956 | Italy | 241/236 |
| 56627 | 6/1944 | Netherlands | 241/236 |

*Primary Examiner*—Howard N. Goldberg

[57] ABSTRACT

A pair of counterrotating crusher rolls are provided with intermeshing teeth having configurations especially adapted to accept and positively feed relatively large portions to be crushed into the nip of the rolls and to crush the fed material into particles of a relatively small size.

2 Claims, 8 Drawing Figures

SYNCHRONOUSLY COORDINATED COUNTERROTATED CRUSHER ROLL TEETH SYSTEM

BACKGROUND OF THE INVENTION

The present invention is especially directed to crushing apparatus in which material to be crushed is fed into the nip between the teeth of a pair of power driven counterrotating rolls to be crushed into relatively fine particles.

The present invention is especially directed to an improvement over the crusher roll assembly disclosed and claimed in a commonly owned DeVita and Watkins application Ser. No. 296,897, filed Aug. 27, 1981, and assigned to the assignee of the present application.

As described in the DeVita et al application referred to above, toothed crusher roll assemblies of the type with which the present invention is concerned have had practical limitations in crushing incoming material to particles of the desired fineness in those situations where the incoming material took the form of relatively large sized lumps or portions. Crusher roll systems exemplary of the prior art are those illustrated in patents:

| | |
|---|---|
| 48,244 | 2,578,540 |
| 842,681 | 2,588,900 |
| 1,435,330 | 3,208,677 |
| 1,750,941 | 3,240,436 |
| 1,824,088 | 3,474,973 |

One specific example with which the present invention is concerned is that of crushing the used sand cores employed in foundry operations, to recover the sand for use in making additional cores. The comparative size of the sand cores and the sand particles is such that the prior art crushing of the cores, or significant portions thereof, had to be accomplished in a two or three step process in which the material was passed through successively finer sets of crusher rolls before the desired particle size could be achieved.

The present invention is especially directed to an improved tooth form which enables a crusher roll assembly to accept relatively large sized pieces of material while being operable to crush this material into relatively fine particles in a single pass through the roll assembly. Whereas previous machinery has normally accomplished 6:1 reduction, the present invention has exceeded 50:1, with 20 inch size material reduced to under $\frac{3}{8}$ of an inch.

SUMMARY OF THE INVENTION

The present invention is especially concerned with a toothed configuration which provides a positive feeding action on relatively large incoming pieces of material and at the same time crushes the material into relatively fine particles while maintaining an adequate clearance between the teeth on cooperating anvil and crusher rolls.

An anvil roll may be formed with teeth of substantially the same configuration as that of the anvil roll teeth in the aforementioned DeVita et al application. The anvil roll teeth are formed with flat trailing edge surfaces which preferably lie in planes which may be substantially radial to the axis of rotation of the anvil roll. The leading edges of the anvil roll teeth are defined by a concavely curved surface.

The essence of the present invention is found in the shape of the crusher roll teeth which differs from that disclosed in the above mentioned DeVita application in two primary respects. First, according to the present invention, the leading edge surface of the crusher roll teeth is a substantially flat surface, like that in the DeVita application, however, in contrast to the teeth of the DeVita et al application, this generally flat surface is inclined relative to a true radial plane so that the base of the leading edge of the tooth is located forwardly, with respect to the direction of rotation, of the tip portion of the leading edge. The tip of the tooth of the crusher roll takes the form of a tip portion lying at a constant radial distance from the crusher roll axis, while the trailing edge of the crusher roll is convexly curved to a complementary relationship with the leading edge of the anvil roll teeth.

This configuration allows a closer approach of the substantially flat leading edge of the crusher roll to the substantially flat trailing edge of the anvil roll tooth during the crushing operation, thus achieving a finer particle at the conclusion of the crushing operation, while still providing adequate clearance between the teeth of the respective rolls.

Further objects and features of the invention will become apparent with reference to the following specification and to the drawings.

IN THE DRAWINGS

FIGS. 5, 6, 7, and 8 are sequential views showing the relationship between the teeth on the respective rolls as they pass through the nip.

Figure 1:
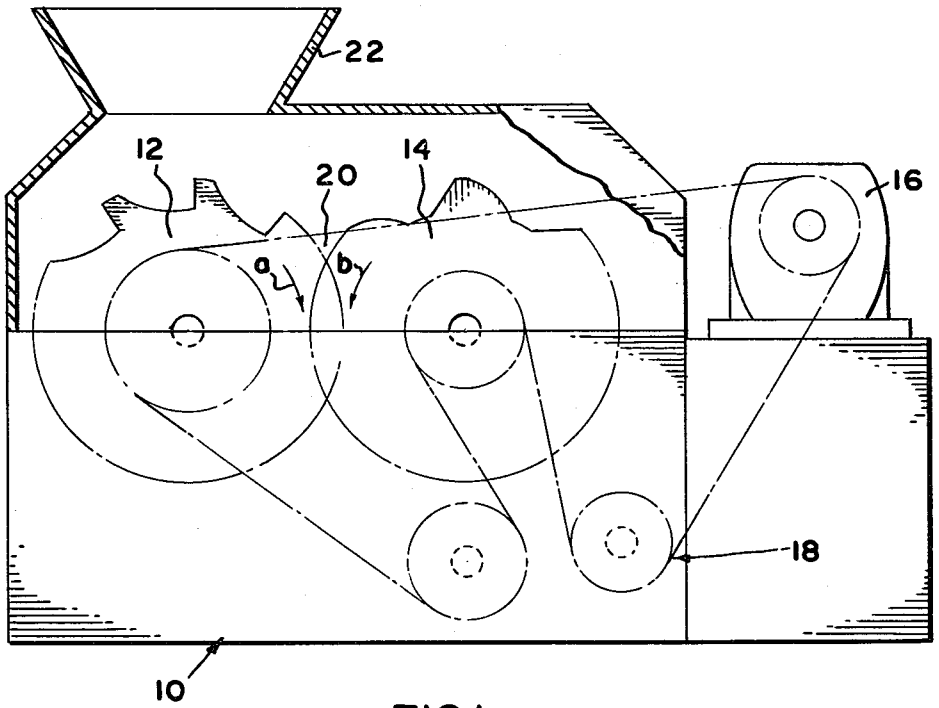
FIG. 1 is a side elevational view, partially in cross section, of a crusher roll assembly embodying the present invention.

Referring first to FIG. 1, an apparatus embodying the present invention includes a frame or housing designated generally 10, within which an anvil roll 12 and a crusher roll 14 are mounted for counterrotation about spaced parallel horizontal axes in the directions of rotation indicated by arrows a and b. A drive motor 16 mounted upon frame 10 is operable to drive rolls 12 and 14 in counterrotation at predetermined speeds of rotation as by means of a chain and sprocket drive designated generally 18. As indicated, rolls 12 and 14 are driven in opposite directions of rotation so that the teeth on the exterior of the respective rolls move downwardly through the nip 20 of the rolls. Material to be crushed by the counterrotating rolls 12 and 14 is fed into the nip via a hopper 22, is carried downwardly by the teeth on rolls 12 and 14 through nip 20, and the material is crushed during its passage through the nip.

Referring now particularly to FIGS. 2 and 5–8, it is seen that the teeth 24 on anvil roll 12 are formed with a concavely curved leading edge 26 and a flat trailing edge 28, the trailing edges 28 of the teeth of anvil roll 12 lying in planes which extend substantially radially with respect to the axis of rotation of roll 12. An peripheral tip portion 30, which lies at a constant radial distance from the axis of roll 12 extends between the radially outer ends of teeth edges 26, 28.In FIGS. 5–8, first, second, and third teeth 24, in a clockwise direction, are designated 24 C, 24B, and 24A respectively. The concave surface forming the leading edge of tooth 24C is designated 28C, and the concave surface forming the leading edge of tooth 24B is designated 28B.

The teeth 32 of crusher roll 14 includes a substantially flat surface 34 which is inclined rearwardly from a true radial plane with respect to the direction of rotation of crusher roll 14. The trailing edge surfaces 36 of teeth 32 of crusher roll 14 are convexly curved and have a radius of curvature just slightly less than the radius of curvature of the concave leading edges 26 of the anvil roll teeth. A relatively short, peripheral tip portion 38, lying at a constant radial distance from the axis of roll 14, extends between the radially outer ends of the leading and trailing edges 34, 36 of the crusher roll teeth, and the crusher roll teeth are spaced circumferentially from each other by bottom lands or roots 40. In FIGS. 5–8, first and second teeth 32, in a counterclockwise direction, are designated 32B and 32A respectively. The convex surface forming the trailing edge of tooth 32A is designated 36A and the flat surfaces forming the leading edges of teeth 32B and 32A are respectively designated 34B and 34A.

It will be noted that, in the embodiment illustrated, anvil roll 12 is shown as having ten teeth, while crusher roll 14 has seven teeth. The respective rolls are driven by drive motor 16 and the chain and sprocket drive 18, at different speeds whose ratio is the inverse of that of the ratio of the number of teeth on the respective rolls so that the intermeshing relationship of the teeth, as shown in FIGS. 5–8 remains constant, with a given tooth on crusher roll 14 moving into intermeshed relationship with a different tooth on anvil roll 14 during successive revolutions of the two rolls.

The crushing action achieved by the toothed configuration described above is best seen in the sequential views of FIGS. 5–8 inclusive.

Figure 5:
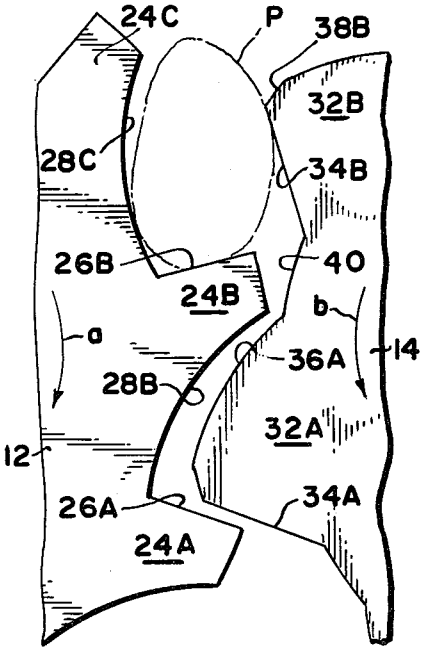

Referring first to FIG. 5, tooth 32A of crusher roll 14 is shown in a position of maximum intermeshed relationship between teeth 24A and 24B of anvil roll 12. Tooth 32B of crusher roll 14 is moving toward intermeshed relationship between teeth 24B and 24C of anvil roll 12, but at the particular stage shown in FIG. 5, is still substantially spaced from any adjacent surface of anvil roll 12 so that a piece of material to be crushed (indicated in broken lines at P) can fall from hopper 22 (FIG. 1) to the position illustrated in FIG. 5.

Figure 6:
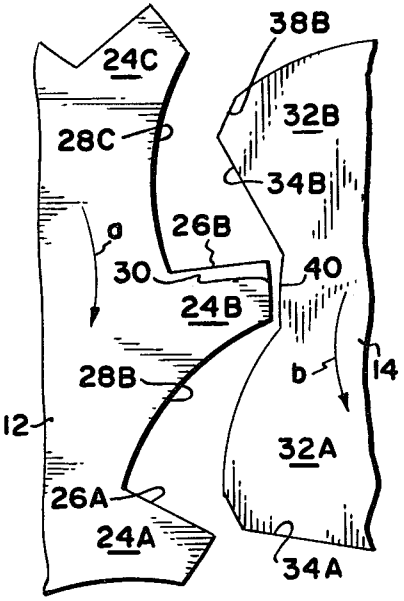

Comparing FIG. 6 with FIG. 5, in FIG. 6, tooth 32B of crusher roll 14 has moved toward the space between teeth 24B and 24C of anvil roll 12 and the spacing between the tip 38B and tooth edge 28C has been substantially reduced from that of FIG. 5. This reduction in spacing might very well crush the particle P indicated in FIG. 5 into at least two segments, which are, in FIG, 6, trapped between the advancing leading edge of tooth 32B of crusher roll 14 and the pocket now defined between edges 26B and 28C of anvil roll 12.

Figure 7:
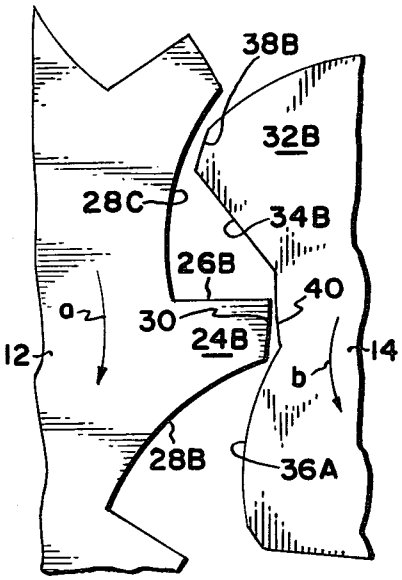

Referring now to FIG. 7, it is seen that the tip portion 38B of crusher roll tooth 32B has advanced from the FIG. 6 position to a new position in which it is beginning to underlie the concavely curved edge 28C on anvil roll 13, the leading edge 34B of tooth 32B on crusher roll 14 now defining, with edges 26B and 28C of anvil roll 12 a substantially closed, generally triangular chamber in which material to be crushed is now trapped.

Figure 8:
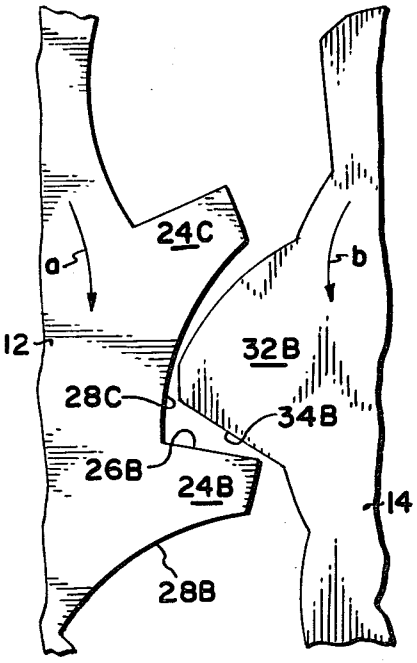

Further rotation of the rolls from the FIG. 7 position to that of FIG. 8 shows this last mentioned triangular chamber defined by edges 34B on the crusher roll and edges 26B, 28C of the anvil roll to now be of substantially reduced volume, further rotation of the rolls from the FIG. 8 position shifting teeth 32B and 24B to the position occupied by teeth 24A and 32A in FIG. 5.

It will be noted that the provision of tip portions 38B on the teeth of crusher roll 14 provides clearance between the teeth on the respective rolls, as best appreciated from FIGS. 7 and 8. It will be noted that the primary crushing surfaces defined by the leading edges 34 of the crusher roll teeth and the flat trailing edges 26A of the anvil roll teeth move into substantial parallelism with each other at a point below the plane containing the axes of rotation of the two rolls, the final relative movement of these teeth being a sort of rolling action of the leading edges of the crusher roll teeth generally radially outwardly along the substantially flat surface of the trailing edges of the anvil roll teeth.

Figure 2:
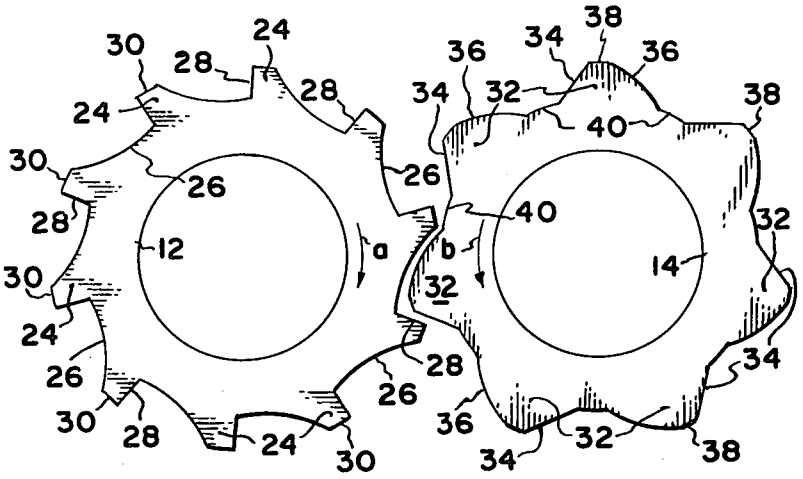
FIG. 2 is a detail side elevational view showing the intermeshing teeth of the anvil and crusher rolls of the apparatus of FIG. 1.
Figure 4:
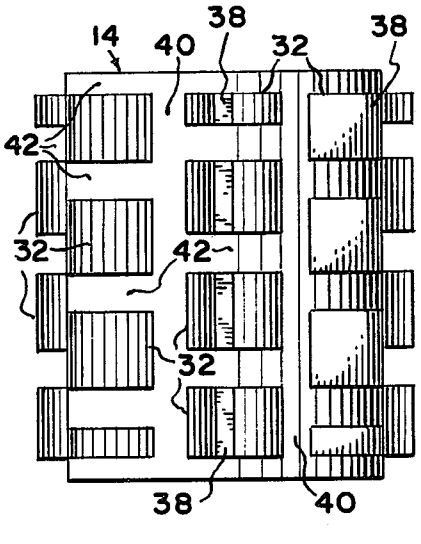
FIG. 4 is a top plan view of the crusher roll.
Figure 3:
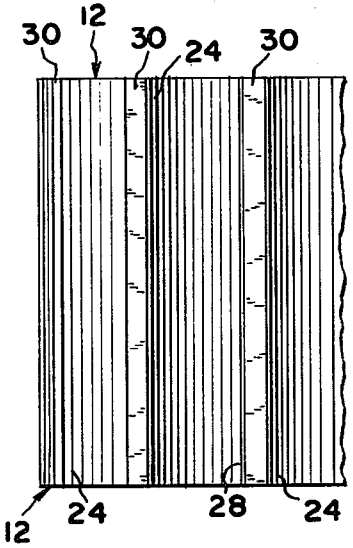
FIG. 3 is a top plan view of the anvil roll.

Because the volume of material trapped between the teeth of the respective rolls, as at the point illustrated in FIG. 7, may have a volume too large to be fully reduced during the crushing operation to the available clearance volume between the respective teeth, the teeth 32 on crusher roll 14 are arranged in axially aligned rows in axially spaced relationship to each other, as best seen in FIG. 4. The spaces between the teeth indicated at 42 in FIG. 4 are so located that the teeth in adjacent rows are axially staggered relative to each other so that the teeth in one axially extending row are aligned with the spaces 42 between the teeth of the next adjacent row. The teeth 24 on anvil roll 12, on the other hand, extend continuously for the entire axially length of the roll as shown in FIG. 3.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

I claim:

1. In a crusher roll assembly having first and second toothed crusher rolls, with a nip between them, mounted for and driven in, coordinated counterrotation about spaced parallel axes to crush material fed into the nip between the rolls; the number of teeth on said second roll being less than the number of teeth on said first roll and said second roll being driven at a higher rate of rotation than said first roll; the improvement wherein the leading edge of each tooth on said first roll is a concavely curved surface and the trailing edge of each tooth on said first roll is a substantially flat surface substantially radial to the axis of said first roll, generally tangential lands connecting said leading and trailing edges each tooth on said second roll having a leading edge surface defined by a substantially flat surface inclined rearwardly with respect to the direction of rotation of said second roll and a convexly curved trailing edge surface generally complementary in shape to the concave leading edge surface of a tooth on said first roll, the leading and trailing edge surfaces of each tooth on the second roll being separated by a generally tangential land, the teeth on the second roll also being connected by roots which intermesh with said lands on the teeth of the first roll; the teeth on the first and second rolls being radially opposite and the axes of rotation of said rolls being spaced from each other by a distance such that the teeth on the respective rolls move in overlapping paths through the nip between the rolls with the teeth on the respective rolls maintained in spaced relationship to each other, the peripheral spacing of the teeth on the said rolls being such that counterrotation of said rolls first advances the substantially flat leading edge surface of a first tooth on the second roll to a position generally opposite the concave trailing edge surface of a first tooth on the first roll while disposing the trailing convex edge surface of a second tooth on the second roll immediately adjacent the first tooth on the second roll in the downstream direction in close mating proximity to the leading concave edge surface of a second tooth on the first roll immediately adjacent the first tooth on the first roll and downstream thereof, the land on the said second tooth on the first roll being opposite a root on the second roll and the substantially flat leading edge surface of the second tooth on the second roll at this time being downwardly inclined and generally parallel to the substantially flat trailing edge surface of a third tooth on the first roll which is immediately downstream of the said second tooth on the first roll; the land on the said second tooth on the second roll permitting the intermeshing second tooth on the first roll and second tooth on the second roll to radially clear, with continued rotation of the rolls.

2. The assembly of claim 1 wherein the peripheral spacing of the teeth is such that counterrotation of said rolls successively advances the substantially flat leading edges of the teeth of the second roll into spaced generally parallel relationship with the respective substantially flat trailing edges of the teeth of the first roll at a location below a plane containing the axes of rotation of said rolls.

* * * * *